US005114542A

United States Patent [19]

Childress et al.

[11] Patent Number: 5,114,542

[45] Date of Patent: May 19, 1992

[54] NONRECOVERY COKE OVEN BATTERY AND METHOD OF OPERATION

[75] Inventors: James H. Childress; Steve E. Newberry, both of Honaker; Charles W. Pruitt, Pounding Mill, all of Va.

[73] Assignee: Jewell Coal and Coke Company, Vansant, Va.

[21] Appl. No.: 587,742

[22] Filed: Sep. 25, 1990

[51] Int. Cl.[5] ..... C10B 5/08; C10B 21/20; C10B 27/06

[52] U.S. Cl. ..... 201/15; 201/26; 201/27; 201/41; 202/93; 202/102; 202/151; 202/263

[58] Field of Search ..... 202/93, 102, 134, 135, 202/145, 151, 211, 263; 201/15, 26, 27, 35, 41; 251/326, 327; 137/375, 553

[56] References Cited

U.S. PATENT DOCUMENTS 3,906,992 9/1975 Leach ..... 251/327
4,124,450 11/1978 MacDonald ..... 201/15
4,287,024 9/1981 Thompson ..... 202/134
4,344,820 8/1982 Thompson ..... 201/15
4,570,670 2/1986 Johnson ..... 137/553

*Primary Examiner*—Joye L. Woodard
*Attorney, Agent, or Firm*—Kerkam, Stowell, Kondracki & Clarke

[57] ABSTRACT

A sole flue nonrecovery coking oven battery includes a plurality of elongated coking ovens constructed in side-by-side relation with common sidewalls downcomers connecting the ovens through the sidewalls to the sole flues, uptakes connecting the sole flues through the sidewalls to an elongated tunnel extending transversely of the battery and a single stack connected to the elongated tunnel applying a draft to all ovens in the battery through the downcomers, sole flues and uptakes, and an improved draft control system includes an adjustable draft regulating valve for controlling the flow of gas from the uptakes beneath each oven to the common tunnel. An adjustable damper type stack draft valve is also provided for opening and closing the stack to vary the draft applied to the stack to the battery.

19 Claims, 5 Drawing Sheets

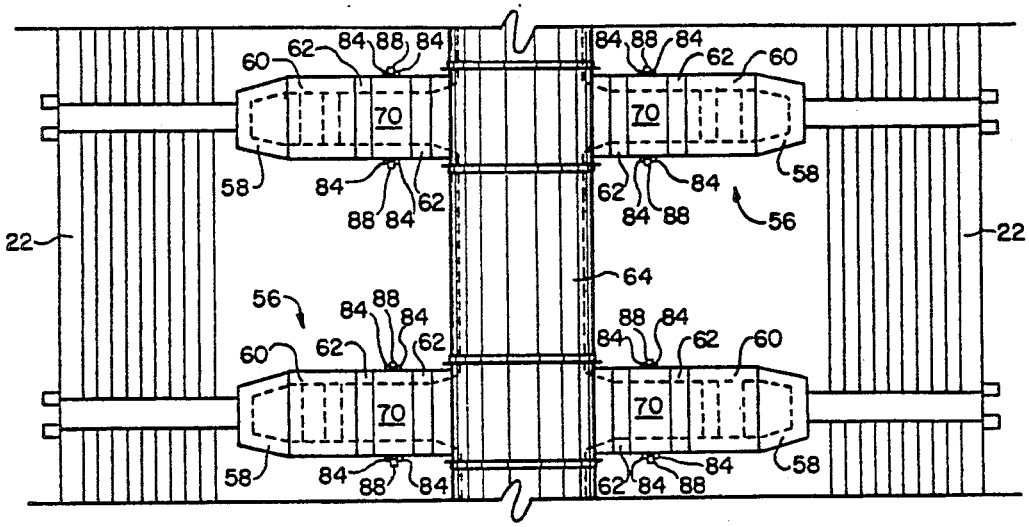
FIG. 2
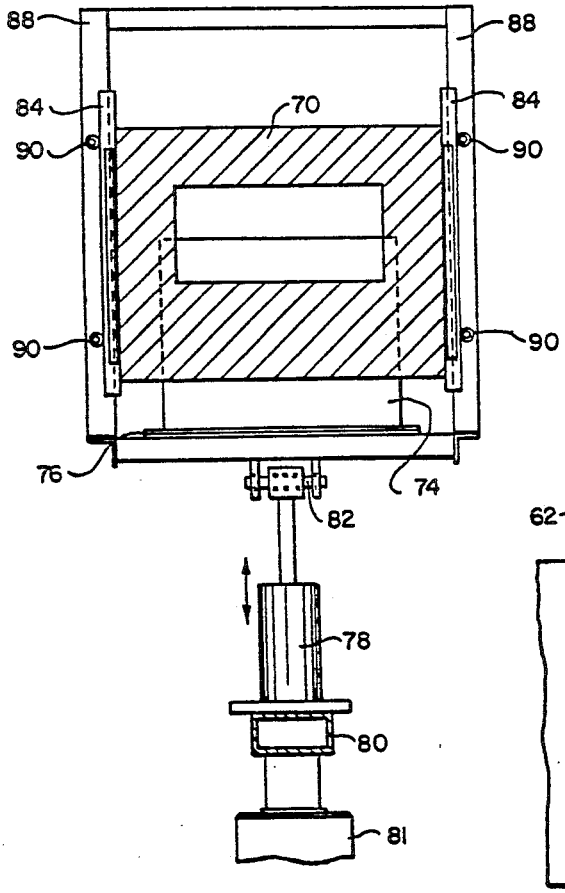
FIG. 7
FIG. 10
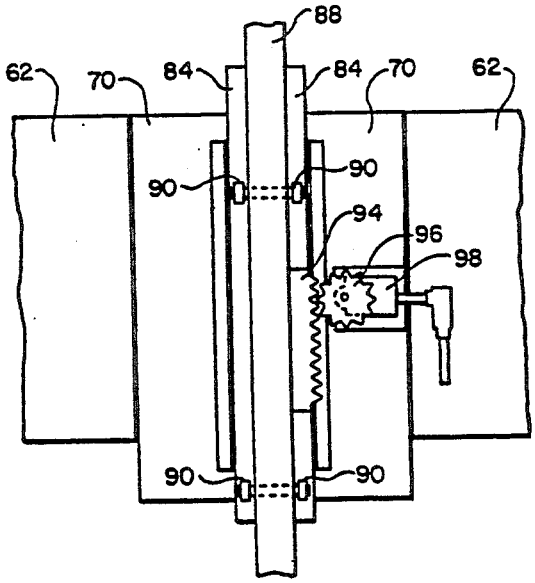

NONRECOVERY COKE OVEN BATTERY AND METHOD OF OPERATION

BACKGROUND OF THE INVENTION

1. Field of the Invention

This invention relates to the nonrecovery coking of coal, and more particularly to an improved coke oven battery for and process of nonrecovery coking of coal.

2. Description of the Prior Art

The practice of producing metallurgical coke by a nonrecovery coking process was for many years all but abandoned in favor of the byproduct coking process in which the coke gas and other chemicals were recovered and/or refined for further use. The high cost of constructing and operating such byproduct coking plants has resulted in renewed interest in the nonrecovery process in recent years, however, and substantial improvements have been made both in the operating efficiency and pollution control of nonrecovery ovens. Examples of modern high speed sole flue type nonrecovery coke ovens now in operation in the United States are disclosed in Thompson U.S. Pat. Nos. 4,287,024 and 4,344,820, and the present invention is an improvement over the coke apparatus and process disclosed in these patents.

Difficulty has been encountered in consistently obtaining a uniform coking rate throughout all the ovens in a battery constructed in accordance with the Thompson patents described above. Such ovens may have a coking chamber of up to fifty (50) feet in length and twelve (12) feet in width, and may be filled to a depth of up to five (5) feet or more with green coal at the beginning of a forty-eight (48) hour coking cycle. Normally eight (8) or more adjacent ovens are connected through a common combustion tunnel to a single stack, and no means other than varying the amount of combustion air admitted through inlets in the oven doors, the sole flues, and the common tunnel, are provided for varying the draft to the respective ovens. Since the uptakes leading from one of the two flue systems under each of two adjacent ovens are connected through a common connector to the combustion tunnel, adjusting the combustion air to one oven necessarily effected the draft to the adjacent ovens. Also, the downcomers are located outboard of the uptakes, making it possible for combustion air to be short circuited through the door inlets to the closest downcomer so that insufficient air reached the center portion of the oven crown, thereby reducing the burning of gases and the coking rate in this area. In contrast, excess combustion air in the area adjacent the door inlets can result in excess burning in this portion of the oven with the consequent waste of product. Further in the event of incomplete coking of the charge near the center of the oven, excess emissions may be released to the atmosphere upon pushing of the incandescent coke at the end of the cycle. It is, therefore, a primary object of the present invention to provide an improved nonrecovery coking battery and method of its operation for the high speed coking of coal at a more uniform coking rate throughout the ovens in the battery.

Another object is to provide such a coking installation including improved means for controlling and regulating the draft supplied to the individual coking ovens in a battery of ovens connected to a common stack.

Another object is to provide such an installation and a method of its operation, which enables an increased yield of high quality coke from a charge of coal.

SUMMARY OF THE INVENTION

In the attainment of the foregoing objects and advantages of the invention, an important feature resides in providing a plurality of sole flue heated nonrecovery coke ovens constructed in side-by-side relation in a battery with two separate sole flue systems located one under each end portion of the oven. Chimney uptakes extending through the walls between adjacent ovens have their outlets connected through a duct system including draft control valve means operable to regulate the flow of hot flue gases through the uptakes from each sole flue system. Thus, by sensing conditions in the respective ovens, for example, the temperature in the crown above the oven charge or in the downcomers, the draft from the sole flues to that oven may be adjusted to thereby regulate the temperature and consequently the coking rate independently of the other ovens in the bottom.

The duct system connected to the uptakes of each sole flue system is connected, above the ovens, to an elongated common combustion tunnel extending above and transversely of the ovens in the battery and a stack connected to the combustion tunnel extends upwardly therefrom to provide a draft to all of the ovens in the battery. In this respect, the term "battery" is used herein to designate the plurality of ovens connected to a common combustion tunnel, although a plurality of such "batteries" may be constructed as a unit. For example, a single battery may consist of nine (9) ovens connected to each common tunnel and stack, with a plurality of such batteries constructed as a single in-line unit, in which case the term "battery" may also be used in the industry to refer to complete installation.

The stack for each individual battery of ovens is equipped, at its top, with a butterfly type stack draft control valve or damper assembly with power means operable to move the valve between the fully open position providing substantially unobstructed gas flow from the stack to the fully closed position substantially sealing the top of the stack. During the coking operation, the position of the stack draft control valve is normally maintained at or near the full open position, but the valve may be adjusted to restrict the flow of gas from the stack to provide the desired draft in the common combustion tunnel. Again, regulating the stack draft will influence the temperature and consequently the coking rate.

During the coking process, a controlled amount of combustion air is admitted to the crown of the individual ovens through adjustable inlets in the doors that close the ends of the respective ovens. Since the downcomers have their inlets located near the center of the ovens, the combustion air and burning gases flow across the top of the charge substantially throughout the length of the oven to produce a more uniform coking rate from the top of the charge. This arrangement eliminates the possibility of the combustion air being drawn from the door inlets directly through the downcomers and starving the center of the oven as was possible in the prior art ovens disclosed in the above-mentioned Thompson patents.

BRIEF DESCRIPTION OF THE DRAWINGS

The foregoing and other features and advantages of the invention will be apparent from the following detailed description, taken in conjunction with the drawings, in which:

FIG. 2 is a top plan view of a portion of the structure shown in FIG. 1;

FIG. 7 is an enlarged sectional view taken along line 7—7 of FIG. 3;

FIG. 10 is a view showing a portion of the uptake draft control valve assembly.

DESCRIPTION OF THE PREFERRED EMBODIMENT

Figure 1:
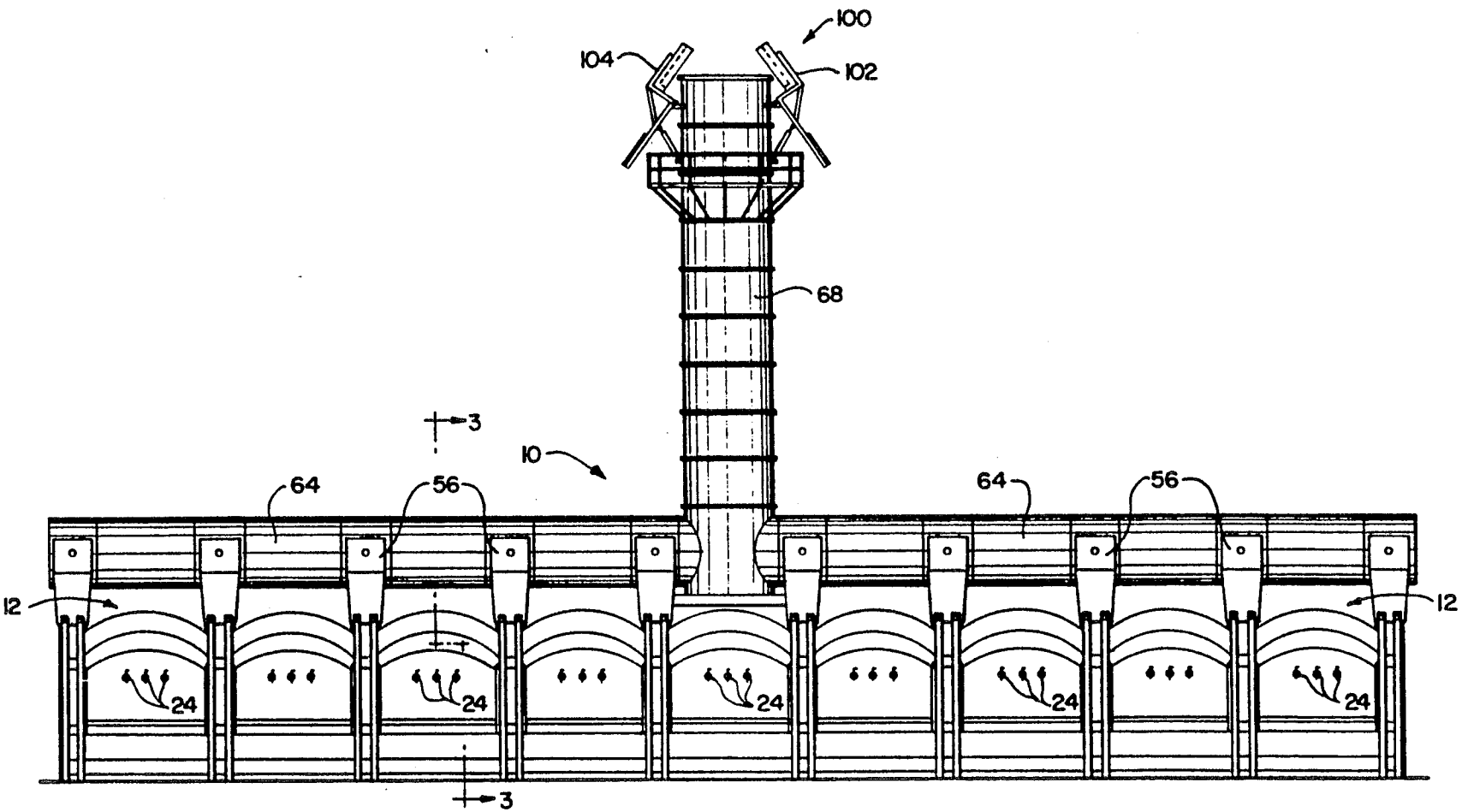
FIG. 1 is a front elevation view of a coal coking battery embodying the invention.

Referring now to the drawings in detail, a coal coking battery 10 embodying the present invention is illustrated as including a plurality of ovens 12 constructed in side-by-side relation with adjacent ovens having common sidewalls 14. The ovens 12 have an elongated coking chamber 16 defined by the opposed vertically extending sidewalls 14, a generally arcuate roof 18 supported on the sidewalls, and a horizontal floor 20 which supports the charge of coal to be coked. The ovens are constructed with open ends which are closed during the coking cycle by substantially identical removable doors 22. Doors 22 preferably are of welded steel construction having a castable refractory lining, with a plurality of adjustable air inlets 24 formed in each door.

Figure 4:
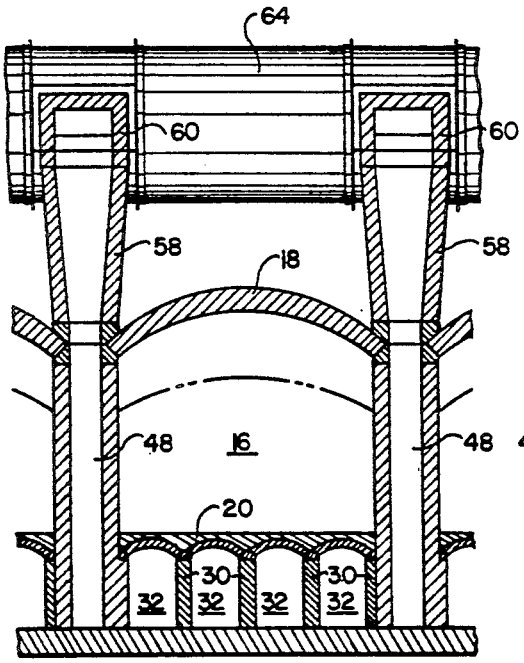
FIG. 4 is an enlarged sectional view taken along line 4—4 of FIG. 3.
Figure 5:
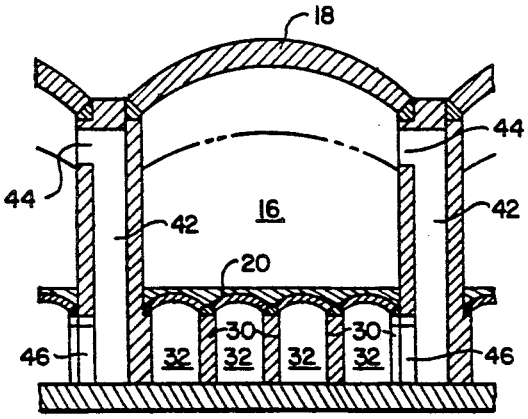
FIG. 5 is an enlarged fragmentary sectional view taken along line 5—5 of FIG. 3.
Figure 6:
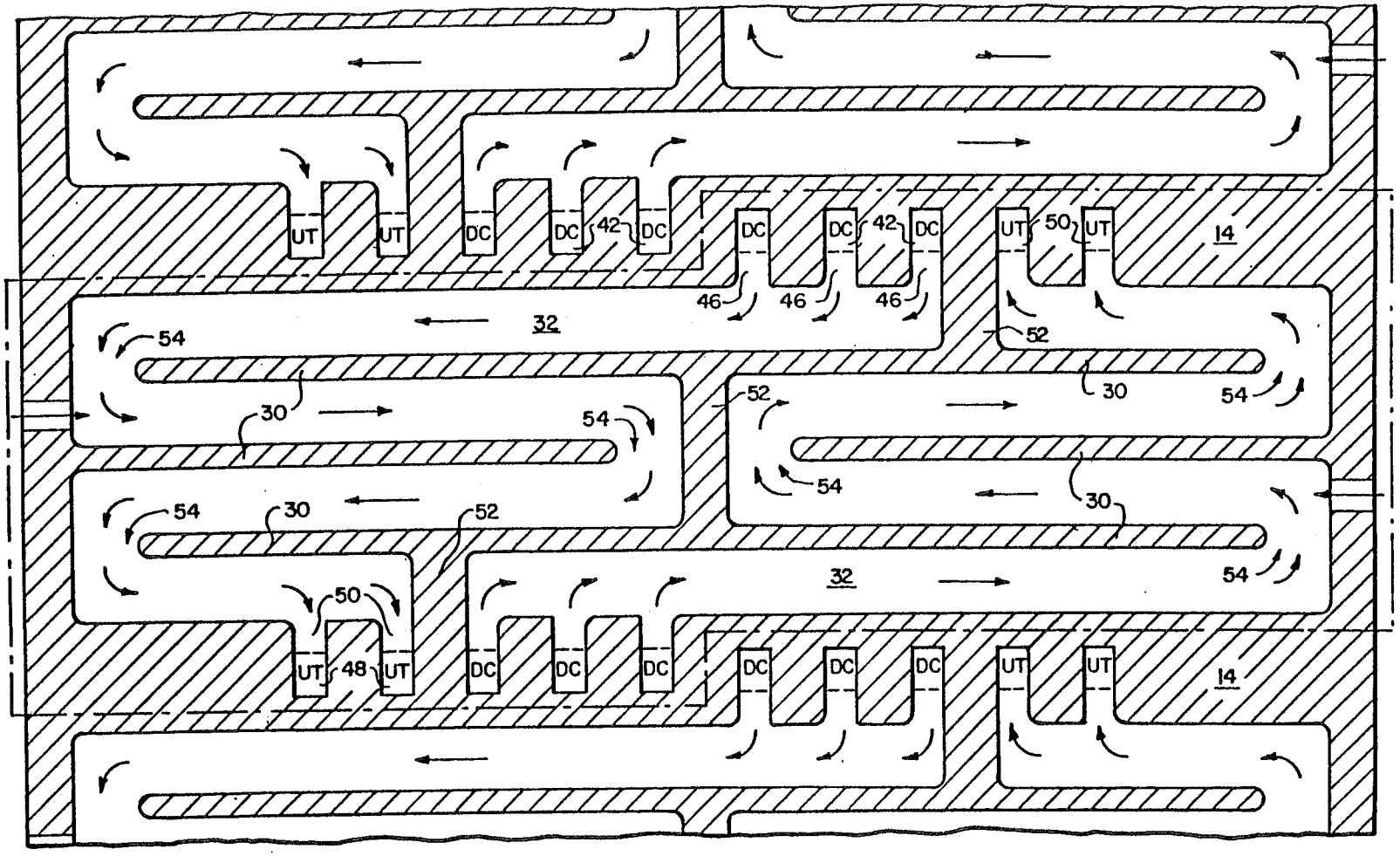
FIG. 6 is a sectional view taken along line 6—6 of FIG. 3.

As best seen in FIGS. 4 and 5, the floor 20 is supported by the sidewalls 14 and by a plurality of parallel intermediate refractory brick walls 30 which cooperate to define a system of elongated sole flues described below. A plurality of vertically extending downcomers, or channels, 42 are formed in the sidewalls 14, with the downcomers each having an inlet 44 communicating with the top or crown portion of the associated coking chamber 16 and an outlet 46 leading into a sole flue tunnel 32 adjacent the sidewall 14. A plurality of chimneys, or uptakes 48 are also formed in each of the common sidewalls 14, with each uptake having an inlet 50 communicating with an adjacent sole flue tunnel 32. The uptakes extend upwardly through the walls 14 for communication with a chimney extension or duct system to be described more fully hereinbelow.

Figure 3:
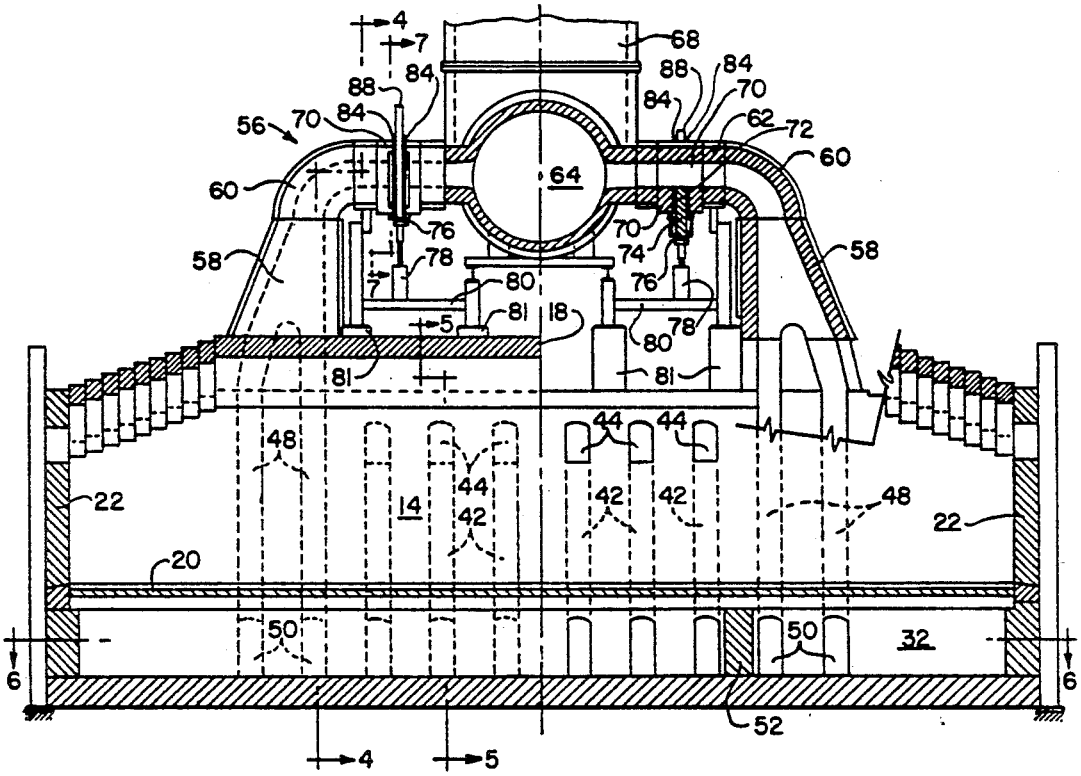
FIG. 3 is a longitudinal vertical sectional view taken along line 3—3 of FIG. 1.

Referring now to FIG. 3, it is seen that there are two separate sole flue heating systems beneath each oven 12. The two sole flue systems beneath an individual oven are enclosed within the broken line in FIG. 3, with the sole flue systems to either side of the area enclosed by the broken line being substantially identical and being associated with adjacent ovens in the battery. As shown, each sidewall 14 is formed with six downcomers and four uptakes, with the six downcomers being located in equally spaced relation, three on either side of the longitudinal centerline of the battery and preferably with the outboard uptake spaced from the longitudinal centerline a distance no more than about 25 percent, and preferably less than about 20 percent, of the total length of the individual oven. In one battery under construction, the total length of the oven is forty six feet eight inches and the distance from the longitudinal centerline of the battery to the outer wall of the outer downcomer is eight feet three inches. The uptakes 48 are located in the wall 14 outboard of the downcomers, with the outboard uptake preferably being spaced from the end of sidewall 14 a distance of at least about 20 percent and preferably about 25 percent of the total length of the oven.

A series of divider walls 52 extend perpendicular to the intermediate walls 30 and divide the respective sole flues 32 into sections isolated from one another on opposite end portions of the oven. Adjacent sole flue sections are interconnected at alternate ends thereof by crossover openings 54 in the walls 30 to provide a continuous back-and-forth flow pattern traversing the width of the oven at one end thereof, and the adjacent sole flue sections 32B are interconnected at the opposite ends by similar crossovers 54 to provide a continuous back-and-forth gas flow pattern across the other end of the oven.

Referring now to FIGS. 3, 4 and 7, it is seen that the pair of uptakes 48 connected to sole flue 32A are connected at the top of wall 14 to a common chimney extension or duct system designated generally by the reference numeral 56. Duct 56 consists of an upwardly extending transition segment 58 in which the gases from the two uptakes are combined, an elbow 60, and a horizontally extending segment 62 connected to a common elongated waste heat or combustion tunnel 64 extending transversely of and above the roofs of the ovens in the battery. The duct system 56 is constructed of a refractory lined generally rectangular metal conduit, and a draft control valve is connected in horizontal section 62 for regulating the draft applied through the connected sole flue system to the associated oven chamber 16.

As best seen in FIG. 1, the common tunnel 64 extends across the full length of battery 10 (which in the embodiment illustrated, consists of nine ovens), and a single common stack 68 connected to the central portion of the combustion tunnel extends upwardly therefrom to apply a draft to the common combustion tunnel and thereby to the sole flue systems beneath all ovens in the battery. A separate duct system 56 is provided to connect each sole flue system 32A and 32B to the common tunnel 64 and, since these duct systems are identical, only one system will be described in detail, it being understood that the description applies to all such systems in the installation.

The draft control valve comprises a refractory lined valve body 70 connected in section 62, with the valve body having a rectangular opening 72 in its bottom wall for receiving a refractory valve plate or damper 74 supported for vertical sliding movement into and out of the valve body between a fully raised position substantially completely closing the gas flow path through the duct system and a lowered position in which the gas flow path is substantially unobstructed. The refractory plate 74 is mounted on a horizontally extending metal base plate 76 which projects laterally outward from each side of the valve body 70, and a fluid cylinder 78 is provided to move the valve plate in the vertical direction. Fluid cylinder 78 is mounted in fixed position on a structural beam 80 supported by columns 81 on top of wall 14, and has its rod end pivotally connected through pin 8 to base plate 76 to move the valve plate 74 as described.

A pair of vertically extending rectangular tubular members 84 are welded in spaced relation to one another on each outer vertical sidewall of the valve body 70 to define guide channels receiving a pair of guide posts 88 mounted on and projecting vertically upward from the opposed outwardly projecting end portions of base plate 76. Posts 88 are guided for vertical sliding movement in the guide channels to retain the refractory valve plate 74 in accurate alignment with the rectangular opening 72 through the bottom of the refractory lined valve body 70. A plurality of guide rollers 90 are mounted on and project outwardly from opposed side faces of posts 88 in position to engage the outwardly directed surface of the rectangular tubes 84 to accurately maintain the valve plates 74 and base plate 76 aligned transversely of the opening 72. The pin connection 82 is constructed with sufficient clearance to permit limited movement of the base plate 76 and of valve plate 74 relative to the fluid cylinder 78 to accommodate limited movement of the valve body as a result of thermal expansion and contraction of the duct system during operation.

As best seen in FIG. 10, one of the guide posts 88 carries a rack 94 which engages a pinion 96 supported on the valve body 70 for rotation by vertical movement of the rack with the valve plate. Pinion 96 is connected to a position indicator switch or potentiometer 98 which provides a signal to an operator's pulpit (not shown) continuously indicating the position of the draft control valve. This enables the operator to accurately position the fluid cylinder of each draft control valve from a common control station to independently control the draft in the respective ovens and thereby maintain a uniform coking rate throughout the battery. Suitable sensors, not shown, including temperature sensors in the crown of the oven or the sole flue, and pressure sensors in the oven crown, sole flues, or uptakes may be used to determine the desired position of the draft control valves, and and signals from these sensors in combination with the signal from the valve position sensors 98, may be fed to a computer or process controller to automatically maintain continuous control over the operation of the entire battery.

Figure 8:
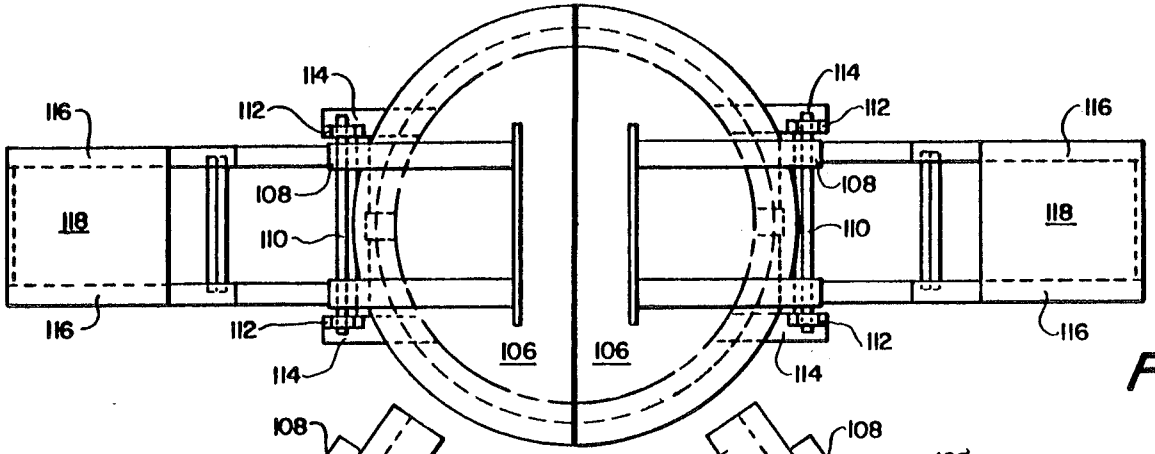
FIG. 8 is an enlarged top plan view of the stack, showing the stack draft valve in the fully closed position.
Figure 9:
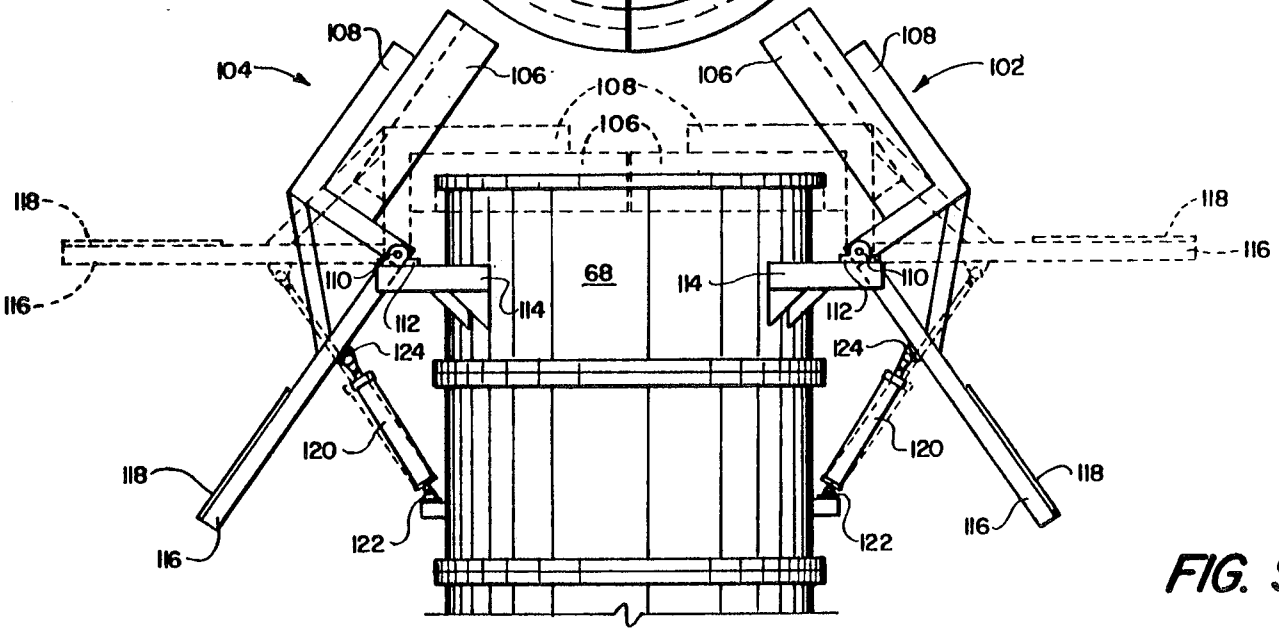
FIG. 9 is an enlarged elevation view of a portion of the stack with the stack draft control valve shown in an alternate position.

Referring now to FIGS. 1, 8 and 9, it is seen that stack 68 is equipped with a draft control damper valve assembly 100 made up of two substantially identical subassemblies 102, 104 mounted on diametrically opposed sides of the stack adjacent its top. Each subassembly includes a semicircular refractory valve plate 106 rigidly mounted on a support frame 108 supported for pivotal movement about a horizontally extending shaft 110. Shaft 110 is supported by a pair of journal bearings 112 on outwardly projecting bracket members 114 rigidly mounted, as by welding, on the metallic outer shell of the refractory lined stack 68. In the closed position shown in FIG. 9, the two valve plate members 106 cooperate to form an inverted lid resting upon and sealing the open top of the stack 68.

Structural frames 108 include a pair of laterally spaced arms 116 projecting outwardly from shaft 110 in the direction opposite to plate 106, and a heavy slab 118 of concrete or the like is mounted on arms 116 to counterbalance the weight of the valve plate 106. A fluid cylinder 120 has its cylinder end pivotally connected to a bracket 122 on stack 68 and its rod end pivotally connected through bracket 124 to the arms 116. As shown in FIG. 9, fluid cylinder 120 may be employed to pivot the arms 116 in a direction to rotate the frame 108 about shaft 110 to move the valve plates 106 between the closed position shown in broken lines to the fully open position shown in full lines. In the closed position, the draft control damper assembly effectively seals the top of the stack, cutting off all draft to the ovens. In the fully opened position, plates 106 offer essentially no resistance to gas flow, enabling these stacks to provide maximum draft to the ovens. It is understood, of course, that the coke oven battery cannot operate to produce coke when the stack is closed and the draft control damper valve assembly is only fully closed when no oven in the battery has a charge of coke therein. Closing the damper valve assembly prevents the stack from drawing cooling air through the ovens when the ovens are not in use to produce coke, thereby preserving heat in the ovens for the start-up of the next coking cycle.

The stack draft control valve assembly 100 may be positioned to act as a damper, restricting the draft applied by the stack to the common tunnel and thereby to all the ovens in the battery. By controlling the draft to maintain the desired subatmospheric pressure in the common tunnel, the overall coking rate in the battery may be influenced while at the same time, adjustment of the chimney uptake draft control valve 66 permits adjustment of the draft to the individual ovens as required to produce a more uniform coking rate throughout the battery.

By positioning the chimney uptakes closer to the ends of the ovens with the downcomers located only in the central section of the oven walls, and by accurately controlling the draft applied to the individual ovens, conditions influencing the coking rate in the ovens can be accurately controlled. This arrangement enables pushing and charging of the ovens on a controlled time schedule while avoiding both the danger of pushing an oven in which the charge has not been fully coked and the waste of coke due to burning after coking is complete. Pushing an oven before the coking process is completed not only results in release of excessive emissions to the atmosphere, but also reduces the quality of the final product.

In operation of a battery of coke ovens embodying the invention, the coking characteristics of the coal charge will, to some extent, determine the draft required to the ovens to maintain the desired burning rate of the coke gas and distillation products. When the coal mix employed is consistent or uniform, it may be possible to provide a fixed or standard open setting for the stack draft control valve and provide the desired control by adjusting the uptake control valve only during the coking cycle. This standard open setting for the stack draft valve may then be adjusted when the mix of coal making up the charge is changed, or when other conditions make it impractical to provide the necessary control by use of the uptake draft control only.

While a preferred embodiment of the invention has been disclosed and described in detail, it is believed apparent that various modifications may be made without departing from the spirit and scope of the invention. For example, while the invention has been described with reference to a battery consisting of nine (9) ovens connected to a common stack, the number of ovens in such a battery could vary. Also, a number of such batteries may be constructed as a single, in-line structural unit with each battery being connected to its own common tunnel and stack. Accordingly, it should be understood that the invention is not limited to the disclosed embodiment, and that it is intended to include all embodiments which would be apparent to one skilled in the art and which come within the spirit and scope of the invention.

What is claimed is:

1. An improved draft control system in combination with a nonrecovery coke oven battery including a plurality of elongated coking ovens having opposite open ends normally closed by removable doors and constructed in side-by-side relation with each adjacent pair of ovens being separated by a common sidewall, separate systems of sole flues located beneath the opposite ends of each of the ovens, a plurality of downcomers in each of the common sidewalls connecting the upper portion of each adjacent oven to one of the sole flue systems beneath that oven, a plurality of uptakes in each of the common sidewalls including at least one uptake connected to one of the sole flue systems beneath that oven, an elongated exhaust tunnel extending above and transversely of the ovens in the battery, a stack connected to the exhaust tunnel and extending upwardly therefrom, and an insulated duct system connecting the exhaust tunnel to said uptakes to provide a continuous gas flow path from each oven through the downcomers, sole flue systems, uptakes, insulated duct system, exhaust tunnel and stack to the atmosphere, said insulated duct system including separate insulated duct means connected between said exhaust tunnel and said at least one uptake connected to each of the sole flue systems, the improvement wherein said draft control system comprises, draft regulating valve means located in each said insulated duct means, each said draft regulating valve means including a movable valve member and first power means operable to position said movable valve member to regulate the flow of hot flue gases from the connected sole flue system to the exhaust tunnel, and stack draft regulating means mounted on said stack and operable to restrict the flow of hot stack gases from said stack to the atmosphere, said stack draft regulating means including damper means and second power means operable to open and close said damper means to thereby control the draft applied by the stack to the exhaust tunnel, whereby a controlled uniform draft is applied by the stack through the exhaust tunnel to all said insulated duct means in the battery, and the flow of hot flue gases from each sole flue system is regulated by said draft regulating valve means to control the draft applied to each oven independently and thereby independently control the coking rate in the respective ovens.

2. The invention as defined in claim 1 wherein each said insulated duct means comprises a refractory lined metal conduit spaced above said ovens, said draft regulating valve means comprising a refractory lined valve body connected in said metal conduit and having a downwardly directed opening receiving said movable valve member, said movable valve member comprising a refractory valve plate mounted for vertical sliding movement through said opening, and wherein said first power means comprises a fluid actuated cylinder supported independently of said insulated duct means and connected to said refractory valve plate, said fluid actuated cylinder being operable to raise and lower said refractory valve plate through said opening in said valve body to control the flow of gas through the metal conduit.

3. The invention as defined in claim 2 further comprising sensing means for continuously sensing the position of each said refractory valve plate.

4. The invention as defined in claim 2 wherein said draft regulating valve means further comprises guide means mounted on the exterior of said valve body and movable therewith upon thermal expansion and contraction of said refractory lined metal conduit to maintain said refractory valve plate in alignment in said valve body.

5. The invention as defined in claim 4 wherein said uptakes are located between the downcomers and the ends of the respective ovens.

6. The invention as defined in claim 5 wherein the distance between the open ends of said elongated ovens and the closest downcomer is at least about 20 percent of the length of the oven.

7. The invention as defined in claim 5 wherein the distance between the open ends of said elongated ovens and the closest downcomer is at least about 25 percent of the length of the oven.

8. The invention as defined in claim 1 wherein said damper means comprises a pair of valve members mounted for limited pivotal movement about spaced parallel axis located one on each side of the stack at the open top thereof, and said second power means comprises means for rotating said valve members about their respective pivotal axes from a generally horizontal position substantially closing the stack to a raised position providing minimum flow restriction through the stack.

9. The invention as defined in claim 8 wherein each said insulated duct comprises a refractory lined metal conduit spaced above said ovens, and wherein said draft regulating valve means comprises a refractory lined valve body connected in said metal conduit and a downwardly directed opening in said valve body, said valve member comprising a refractory valve plate mounted for vertical sliding movement through said opening, and wherein said first power means comprises a fluid actuated cylinder supported independently of said duct and connected to said refractory valve plate, said fluid actuated cylinder being operable to raise and lower said refractory valve plate within said valve body to control the flow of gas through the metal conduit.

10. The invention as defined in claim 9 further comprising sensing means for continuously sensing the position of each said refractory valve plate.

11. The invention defined in claim 1 wherein said uptakes are located in said sidewalls between said downcomers and the open ends of said oven, and wherein the distance between the open ends of said elongated ovens and the closest downcomer is at least about 20 percent of the length of the oven.

12. A method of controlling the draft in a nonrecovery coke oven battery including a plurality of elongated coking ovens having open ends normally closed by removable doors and constructed in side-by-side relation with each pair of adjacent ovens separated by a common sidewall, separate systems of sole flues located beneath the opposite ends of each of the ovens, a plurality of downcomers in each of the common sidewalls connecting the upper portion of each adjacent oven to one of the sole flue systems beneath that oven, a plurality of uptakes in each of the common sidewalls including at least one uptake connected to one of the sole flue systems beneath that oven, an elongated common exhaust tunnel extending above and transversely of the ovens in the battery, a stack connected to the exhaust tunnel and extending upwardly therefrom, and a duct system connecting the exhaust tunnel to said uptakes to provide a continuous gas flow path from each oven through said downcomers, sole flue systems, uptakes, duct system, exhaust tunnel and stack to the atmosphere, said duct system including separate insulated duct means connecting said exhaust tunnel to said at least one uptake connected to each said sole flue system, the improvement comprising the steps of providing a draft regulating valve located in each said insulated duct means, and selectively adjusting the position of said draft regulating valves to thereby regulate the flow of hot flue gases from the respective sole flue systems to the exhaust tunnel to thereby control the coking rate in the ovens.

13. The method defined in claim 12 further comprising the step of sensing the temperature within each coke oven, said draft regulating valves being adjusted in response to said sensed temperature.

14. The method defined in claim 12 further comprising the step of providing a damper valve on the stack for restricting the flow of hot stacked gases to the atmosphere, and regulating the position of the damper valve to thereby control the draft applied by the stack to the exhaust tunnel.

15. An improved draft control system in combination with a nonrecovery coke oven battery including a plurality of elongated coking ovens having opposite open ends normally closed by removable doors and constructed in side-by-side relation with each pair of adjacent ovens in the battery separated by a common sidewall, separate systems of sole flues located beneath the opposite ends of each of the ovens, a plurality of downcomers in each of the common sidewalls connecting the upper portion of each adjacent oven to one of the sole flue systems beneath that oven, a plurality of uptakes in each of the common sidewalls between said downcomers and the open ends of said ovens including at least one uptake connected to one of the sole flue systems beneath that oven, an elongated common exhaust tunnel extending above and transversely of the ovens in the battery, a stack connected to the exhaust tunnel and extending upwardly therefrom, and an insulated duct system connecting the exhaust tunnel to said uptakes to provide a continuous gas flow path from each oven through the downcomers, sole flue systems, uptakes, insulated duct system, exhaust tunnel and stack to the atmosphere, said insulated duct system including separate insulated duct means connected between said exhaust tunnel and said at least one uptake connected to each of the sole flue systems, the improvement wherein said draft control system comprises, in combination, draft regulating valve means located in each said separate insulated duct means, each said draft regulating valve means including a refractory lined valve body having a downwardly directed opening formed therein, a movable refractory plate valve member mounted for vertical movement through said downwardly directed opening, sensing means for continuously sensing the positions of said movable refractory valve plate, a fluid actuated cylinder supported independently of said duct means and connected to said refractory plate valve member, said fluid actuated cylinder being operable to raise and lower said refractory plate through said opening in said valve body to control the flow of gas through each insulated duct means independently, and guide means mounted on the exterior of said valve body and movable therewith upon thermal expansion and contraction of said refractory lined metal conduit to maintain said movable refractory valve plate in alignment in said valve body, and wherein the distance between the open ends of said elongated ovens and the closest downcomer is at least about 20 percent of the length of the oven.

16. The invention as defined in claim 15 wherein the distance between the open ends of said elongated ovens and the closest downcomer is at least about 25 percent of the length of the oven.

17. A method of controlling the draft in a nonrecovery coke oven battery including a plurality of elongated coking ovens having opposite open ends normally closed by removable doors and constructed in side-by-side relation with each pair of adjacent ovens separated by a common sidewall, at least one system of sole flues extending beneath each oven, at least one downcomer in each common sidewall connecting the upper portion of each adjacent oven to a sole flue system beneath one of the adjacent ovens, at least one uptake in each common sidewall connected to the sole flue systems beneath one of the adjacent ovens, an elongated common exhaust tunnel extending above and transversely of the ovens in the battery, a stack connected to the exhaust tunnel and extending upwardly therefrom, and a duct system connecting the exhaust tunnel to said uptakes to provide a continuous gas flow path from each oven through the downcomers, the sole flue systems, the uptakes, the duct system, the exhaust tunnel and the stack to the atmosphere, said duct system including separate insulated duct means connecting said exhaust tunnel to said at least one uptake connected to each said sole flue system, the improvement comprising the steps of providing a draft regulating valve located in each said insulated duct means, and selectively adjusting the position of the respective draft regulating valves to regulate the flow of hot flue gases from the connected sole flue system to the exhaust tunnel to thereby control the coking rate in the individual ovens in the battery.

18. The method defined in claim 17 further comprising the step of sensing the temperature within each coke oven, and adjusting the position of said draft regulating valves in response to said sensed temperature.

19. The method defined in claim 17 further comprising the step of providing a damper valve on said stack for restricting the flow of hot stack gases to the atmosphere, and regulating the position of the damper valve to thereby control the draft applied by the stack to the exhaust tunnel.

* * * * *